US007614918B1

(12) United States Patent
Wu

(10) Patent No.: US 7,614,918 B1
(45) Date of Patent: Nov. 10, 2009

(54) CABLE CONNECTOR ASSEMBLY

(75) Inventor: Jerry Wu, Irvine, CA (US)

(73) Assignee: Hon Hai Precision Ind. Co, Ltd., Taipei Hsien (TW)

( * ) Notice: Subject to any disclaimer, the term of this patent is extended or adjusted under 35 U.S.C. 154(b) by 0 days.

(21) Appl. No.: 12/156,976

(22) Filed: Jun. 6, 2008

(51) Int. Cl.
*H01R 24/04* (2006.01)

(52) U.S. Cl. ..... 439/669

(58) Field of Classification Search ..... 439/669, 439/668, 578–585
See application file for complete search history.

(56) References Cited

U.S. PATENT DOCUMENTS

| | | | | |
|---|---|---|---|---|
| 3,626,360 | A | 12/1971 | Cole | |
| 4,676,577 | A * | 6/1987 | Szegda | 439/584 |
| 4,907,983 | A * | 3/1990 | Wilson | 439/278 |
| 5,267,877 | A * | 12/1993 | Scannelli et al. | 439/584 |
| 5,290,179 | A | 3/1994 | Weingartner | |
| 5,879,191 | A * | 3/1999 | Burris | 439/584 |
| 6,439,933 | B1 * | 8/2002 | Moji | 439/669 |
| 6,767,249 | B1 * | 7/2004 | Li | 439/579 |
| 6,910,906 | B2 * | 6/2005 | Schorn | 439/274 |
| 6,913,478 | B2 * | 7/2005 | Lamirey | 439/259 |
| 7,021,965 | B1 * | 4/2006 | Montena et al. | 439/578 |
| 2004/0147164 | A1 * | 7/2004 | Li | 439/578 |

FOREIGN PATENT DOCUMENTS

| | | |
|---|---|---|
| CN | 2901626 | 5/2007 |

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

A cable connector assembly (100) for a connection with an electrical conductor, includes a contact shaft (1) for a connection with the electrical conductor and a cable (5), a tubular sleeve (2) covering on the contact shaft, and a metal tube (4) with a bevel inner surface (40) according with a bell-mouthed external surface of the tubular sleeve to be covered on the tubular sleeve.

12 Claims, 6 Drawing Sheets

CABLE CONNECTOR ASSEMBLY

BACKGROUND OF THE INVENTION

1. Field of the Invention

The present invention relates to a cable connector assembly for a connection with an electronic device and, more particularly, a cable connector having a metal tube provided thereon.

2. Description of Prior Arts

A great number of cable connector assemblies of the most varied constructions are known. There numerous constructional forms are disclosed in many publications.

U.S. Pat. No. 5,290,179 discloses a cable connector assembly comprising primarily a tubular shaft served as an external contact, a bushing having a greater diameter than the shaft and covering on the shaft, and a gripping sleeve receiving the bushing and the shaft. The bushing which carries an external thread adjacent to the aforementioned shaft is slid onto the shaft. The gripping sleeve with a central bore hole for a passage of a cable. One end of the gripping sleeve has an internal thread by which the gripping sleeve can be screwed onto the thread of the bushing and covers the aforementioned shaft.

However, such previously known constructions are proper to be used in a larger electronic device. When a small cable connector assembly is needed, it is difficult to design precise threads on the bushing and the gripping sleeve and difficult further to screw the gripping sleeve on the bushing tightly. Moreover, the gripping sleeve, to the extent that it is constructed in one piece and is made of harder material, extends over the cable in a cantilevering manner. Since there is no soft cooperation at the end of the gripping sleeve to accommodate the cable, the cable can only exert a limited distortion. If the cable extends or twists, one end thereof connecting with the gripping sleeve will be broken in two parts. Then a desirable transmission between the cable connector assembly and the electronic device will be broken.

Therefore, the present invention is directed to solving these various problems by providing an improved cable connector.

SUMMARY OF THE INVENTION

An object, therefore, of the invention is to provide an cable connector assembly with a simple module to assemble and capable of achieving a desirable connection between the cable connector assembly and an electronic device.

In the exemplary embodiment of the invention, a cable connector assembly for a connection with an electrical conductor, includes a contact shaft for a connection with the electrical conductor and a cable, a tubular sleeve covering on the contact shaft, and a metal tube with a bevel inner surface according with a bell-mouthed external surface of the tubular sleeve to be covered on the tubular sleeve.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
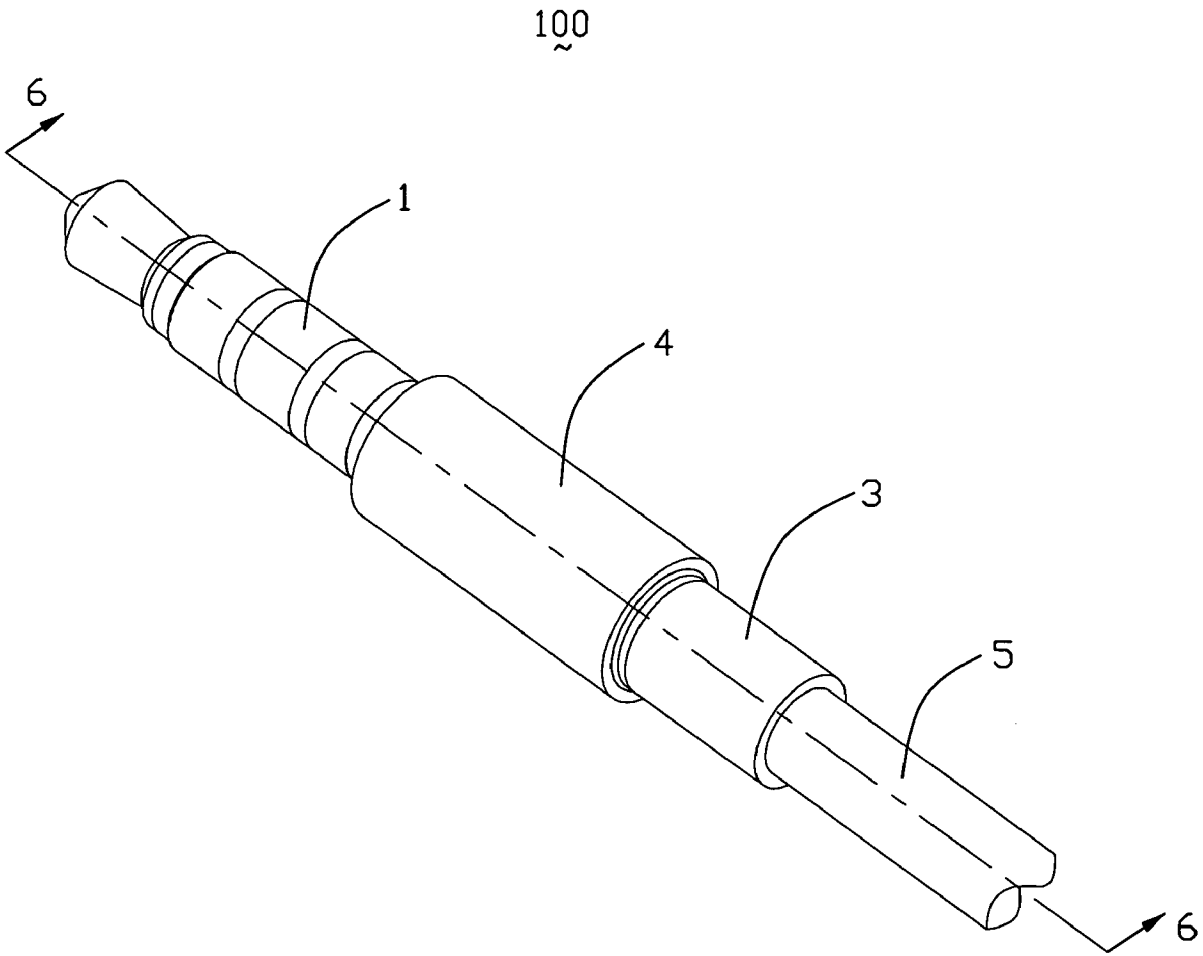
FIG. 1 is a perspective view of a cable connector assembly of present invention.

Referring now to FIG. 1 to FIG. 6, a cable connector 100 assembly, such as an audio plug is shown. The cable connector assembly 100 of present invention for connecting with an electronic device (not labeled), such as a MP3 player or others, comprises a contact shaft 1, a tubular sleeve 2, a bushing 3, a metal tube 4, and a cable 5. One end of the contact shaft 1 is received in the tubular sleeve 2 to link with the cable 5, and the other end is served to connect with the electronic device. The tubular sleeve 2 connects with the bushing 3 as an integer thereafter to receive an association of the contact shaft 1 and the cable 5. The metal tube 4 is glued on the tubular sleeve 2 and the bushing 3 and is dimensioned in such length which is longer than the tubular sleeve 2 but shorter than the association of the tubular sleeve 2 and the bushing 3.

Figure 2:
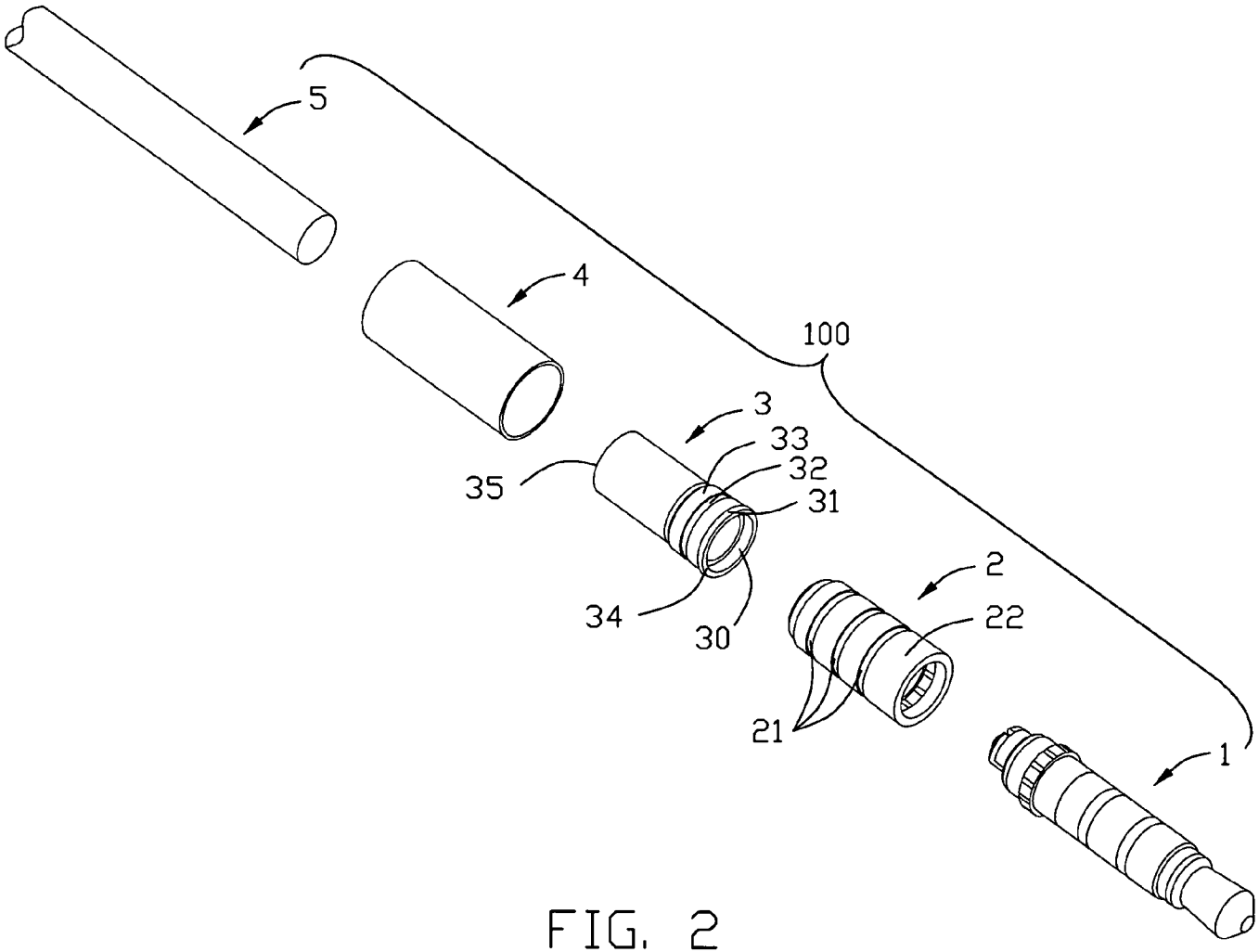
FIG. 2 is an exploded view of the cable connector assembly of present invention as shown in FIG. 1.
Figure 3:
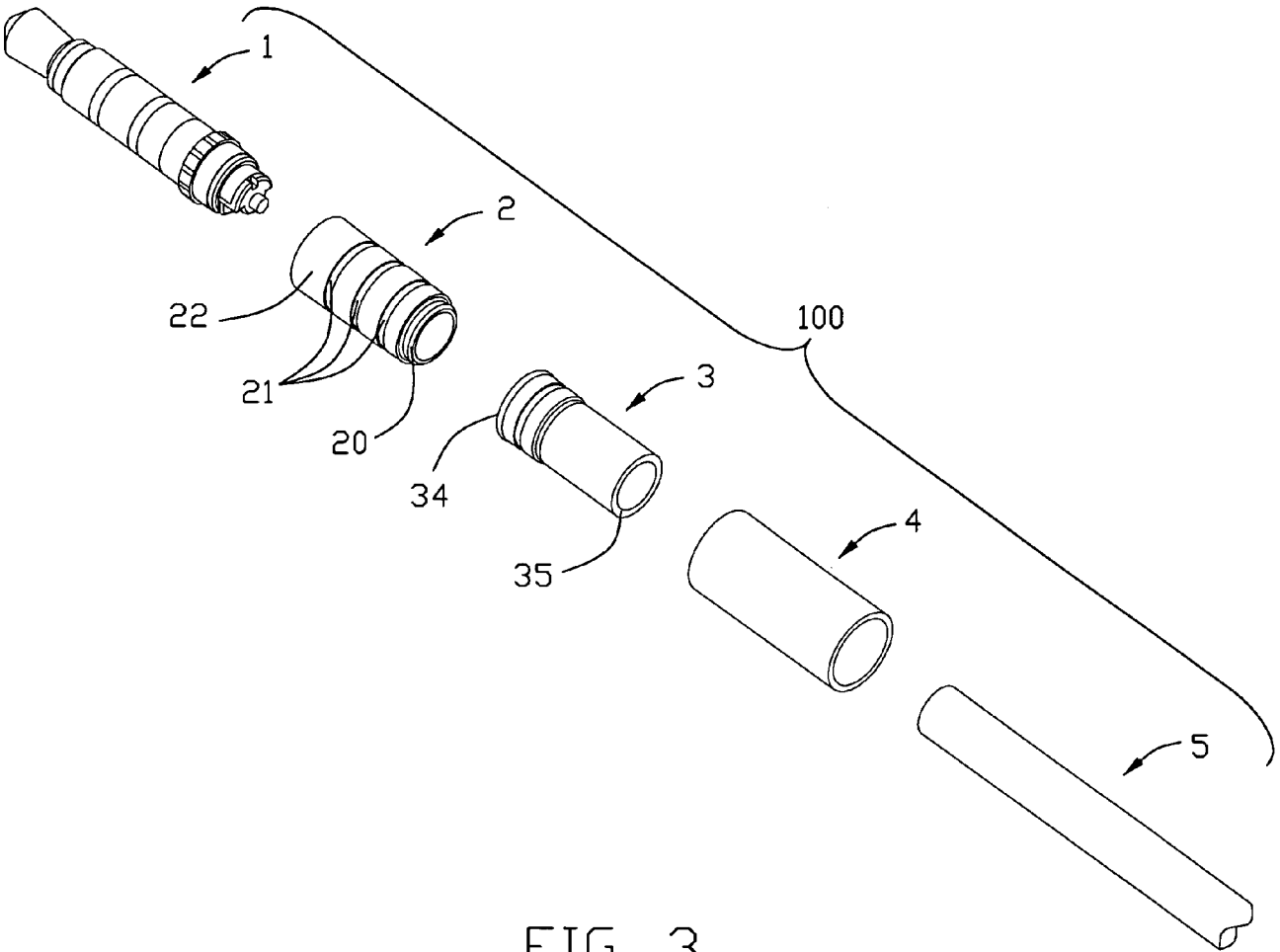
FIG. 3 is an exploded view of the cable connector assembly of present invention as shown in FIG. 1 in another aspect.

As shown in FIG. 2 and FIG. 3, the bushing 3 is preferably made of plastic or soft material and easy to deform to prevent cable jacket (not labeled) bare when the cable 5 bend and twist, and comprises a first end 34 and a second end 35. Proximate to the first end 34, the bushing 3 further comprises a fitting portion 30 for the tubular sleeve 2 assembly and retention, at least a first annular channel 32 for glue to flow or stay, a receiving header 31 to be pushed down by the metal tube 4 to increase the bushing 3 retention force, and a first assembly portion 33 to fit with the metal tube 4. In a relax state, the receiving header 31 has a diameter which is larger than that of the assembly portion 33.

The tubular sleeve 2 is preferably made of harder material to protect solder joint, and comprises an inserting portion 20 to be clamped in the fitting portion 30 of the bushing 3, a plurality of second annular channels 21 for glue to flow or stay, and a second assembly portion 22 remote from the inserting portion 20. Each second annular channel 21 is separated from another adjacent channel in a common distance. In the preferable embodiment of present invention, the tubular sleeve 2 is designed in a bell-mouthed shape, and the diameter of the second assembly portion 22 is larger than that of the insertion portion 20. The second assembly portion 22 and the first assembly portion 33 has, respectively, a flat surface for the metal tube 4 assembly easily and airtightly.

Figure 6:
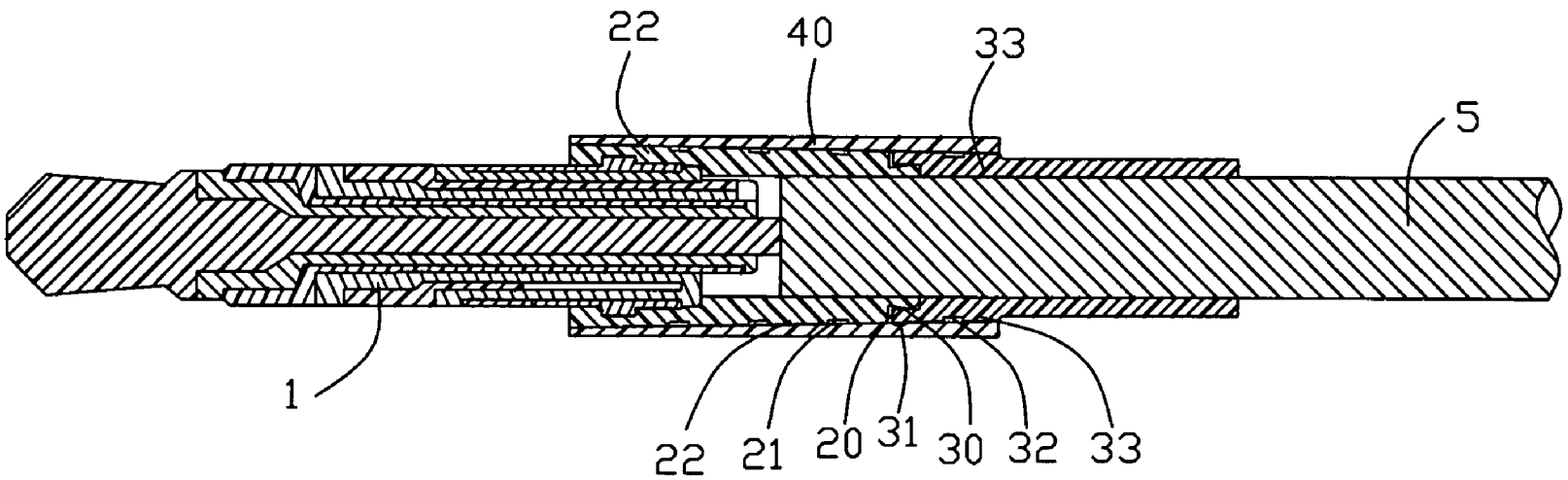
FIG. 6 is a cross-sectional view of the cable connector assembly as shown in FIG. 1 taken along line A-A.

The metal tube 4 has a flat inner bevel surface 40 according with the bell-mouthed external surface of the tubular sleeve 2 to fit with the first assembly portion 33 and the second assembly portion 22. As shown in FIG. 6, the inner diameter of the metal tube 4 becomes more and more small towards the contact tube 1, but the entire outer diameter is generally in a same dimension.

Figure 4:
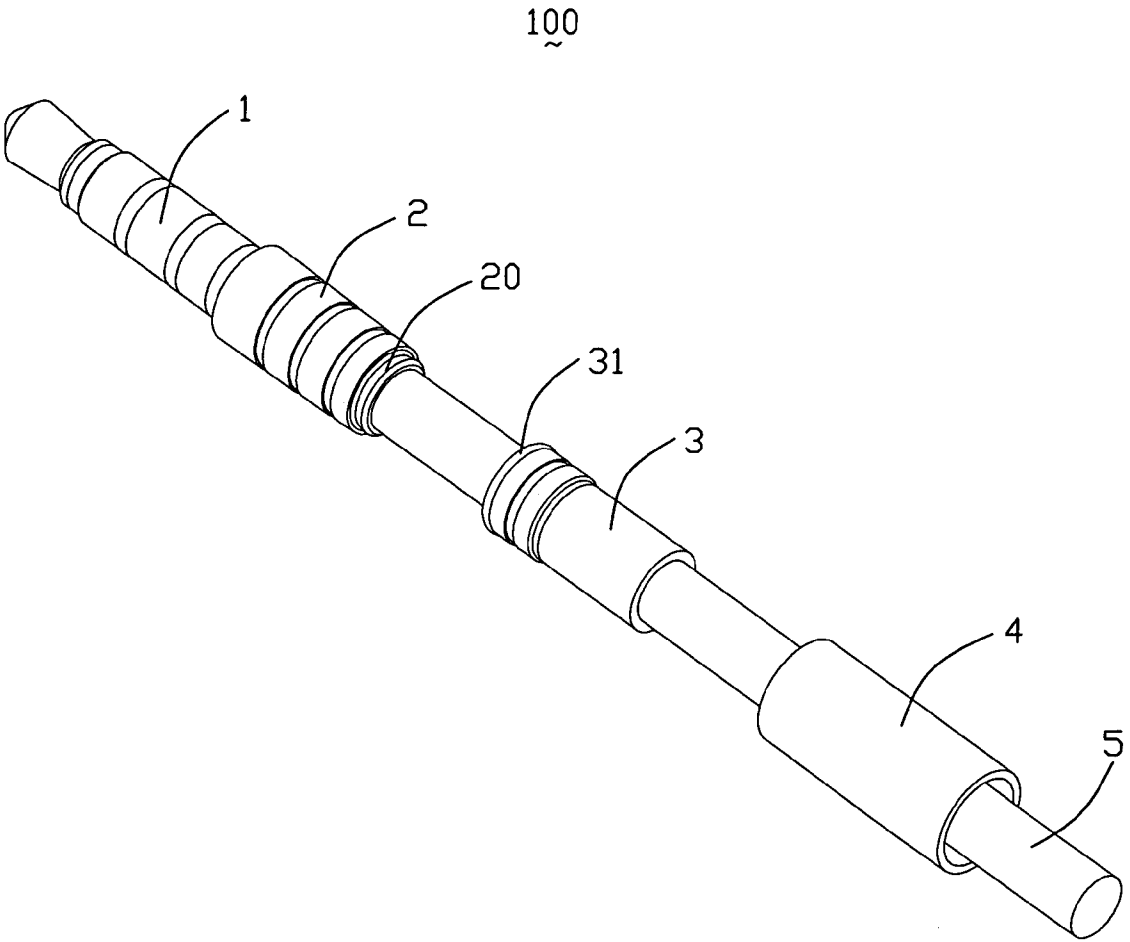
FIG. 4 is a perspective view of a first assembly step of the cable connector assembly.
Figure 5:
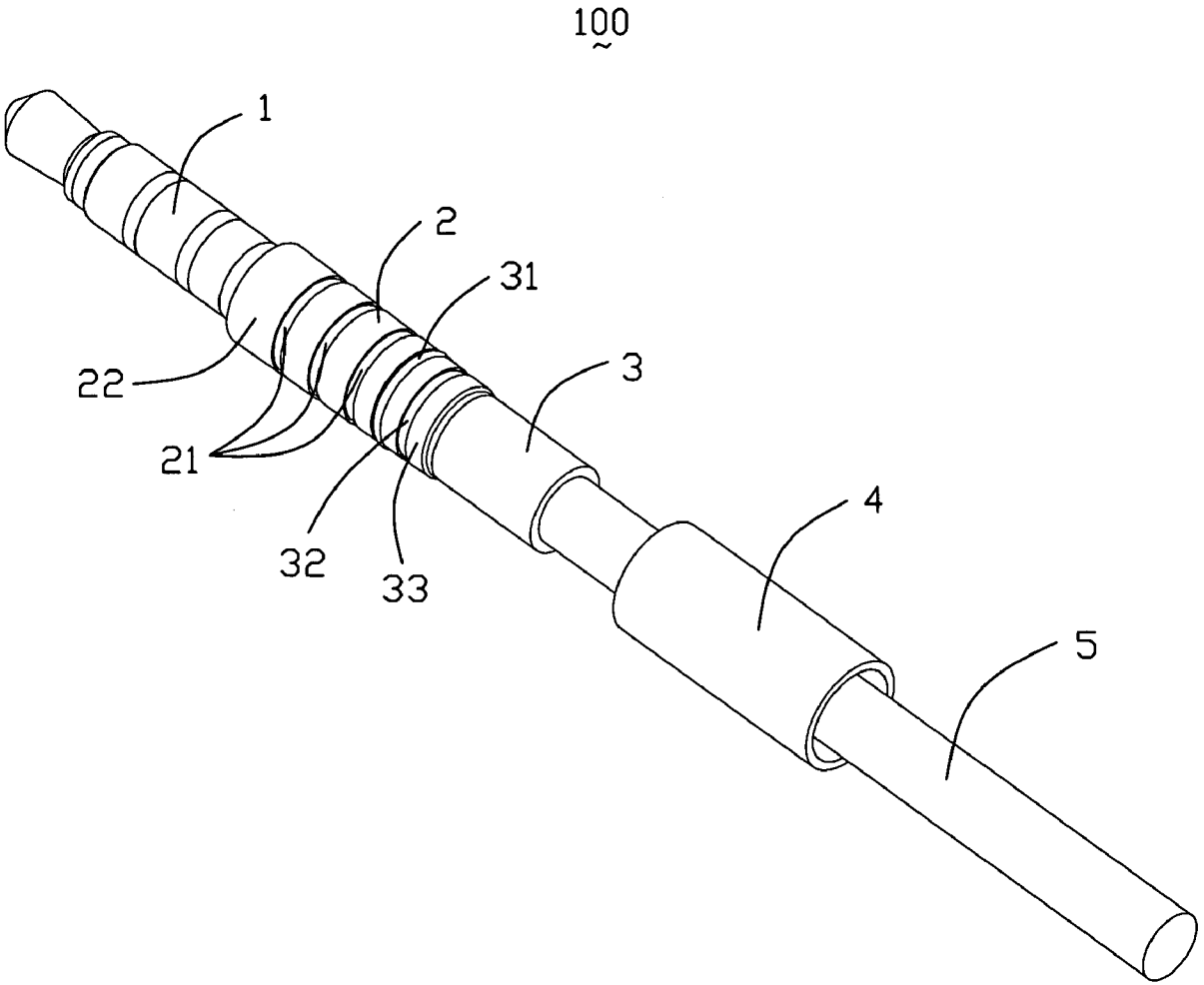
FIG. 5 is a perspective view of a further assembly step of the cable connector as show in FIG. 4.

Together with FIG. 4 to FIG. 6, the relationship between the elements of the cable connector assembly 100 as described above and the entire assembly process of the cable connector assembly 100 will be illustrated in following segments.

The contact shaft 1 and the cable 5 join with each other with the tubular sleeve 2 covering thereon, and further that the bushing 3 slides on the cable until the inserting portion 20 is retained in the fitting portion 30 tightly, and further to make glue in the first annular channel 32 and the second annular channel 21. Finally, the metal tube 4 slides on the cable and is to be glued on the tubular sleeve 2 and the bushing 3 with the first assembly portion 33 and the second assembly portion 22 received in the metal tube 4 airtightly. Thus the entire cable connector assembly has been assembled. In such assembly process, it needs a more little friction than a common way, such as a metal tube with a unchangeable inner diameter. As shown in FIG. 1, since the metal tube 4 has the bevel inner surface 40 to mate with the bevel outer surface of the tubular sleeve 2 and the bushing 3, when the metal tube 4 is slid on the tubular sleeve 2 and the bushing 3, the friction therebetween gradually comes into being and increases to a maximal degree in the end, comparing with a common way that the friction comes into being and is up to a maximal degree at the beginning.

It can be seen from the foregoing description and from the attached drawings that the metal tube 4 is glued on the tubular sleeve 2 and the bushing 3 tightly with some channels formed thereon for glue to flow and stay instead of being screwed thereon by means of internal threads on the inner face of the metal tube 4 and external threads on the external face of the tubular sleeve 2 and the bushing 3. On the other hand, the bushing 3 is made of soft material having an amortizable force and allows the cable 5 to bend and twist but not to be damaged. Particularly, a minimize cable connector assembly can be achieved with such construction, and a simple module also can be manufactured without a precise thread thereon. Furthermore, it is convenient and little friction than a common way since the inner bevel surface of the metal tube and a bell-mouthed external surface of the tubular sleeve to make the metal tube 4 covered on the tubular sleeve 2 tightly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly for a connection with an electrical conductor, comprising:

a contact shaft for a connection with the electrical conductor and a cable;

a tubular sleeve covering the contact shaft and having a bell-mouthed external surface; and a metal tube with a bevel inner surface covering the bell-mouthed external surface of the tubular sleeve.

2. The cable connector assembly as claimed in claim 1, wherein the tubular sleeve comprises a plurality of annular channels on a fitting portion of the tubular sleeve.

3. The cable connector assembly as claimed in claim 1, further comprising a bushing which has an inserting portion received in a fitting portion of the tubular sleeve.

4. The cable connector assembly as claimed in claim 3, wherein the metal tube is dimensioned in such length which is longer than the tubular sleeve and shorter than an association of the tubular sleeve and the bushing.

5. The cable connector assembly as claimed in claim 3, wherein the bushing comprises a plurality of channels for glue to flow and stay.

6. The cable connector assembly as claimed in claim 2, wherein the annular channels of the tubular sleeve is separated from another adjacent annular channel generally in the same distance.

7. The cable connector assembly as claimed in claim 3, wherein the bushing is made of soft material and easy to deform.

8. The cable connector assembly as claimed in claim 1, wherein the tubular sleeve is made of harder material to prevent solder joint.

9. A cable connector assembly comprising:

a columnar insulative housing equipped with a plurality of coaxially arranged contacts having contacting areas exposed upon a circumferential exterior surface of the housing;

a cable connected to a rear end of the housing and mechanically and electrically connected to the contacts, said cable defining an outer jacket around a front end region; and a sleeve surrounding a joint region of the housing and the cable; wherein an interface between the sleeve and the housing is essentially beveled and converged toward the cable.

10. The cable connector assembly as claimed in claim 9, further enclosing a bushing surrounding the jacket intimately proximal to the sleeve.

11. The cable connector assembly as claimed in claim 10, wherein said bushing is enclosed by the sleeve.

12. The cable connector assembly as claimed in claim 10, wherein an interface between the bushing and the sleeve defines a step structure.

* * * * *